US005624743A

United States Patent [19]

Malhotra

[11] Patent Number: 5,624,743

[45] Date of Patent: Apr. 29, 1997

[54] INK JET TRANSPARENCIES

[75] Inventor: Shadi L. Malhotra, Crescent, Canada

[73] Assignee: Xerox Corporation, Stamford, Conn.

[21] Appl. No.: 606,699

[22] Filed: Feb. 26, 1996

[51] Int. Cl.[6] ..... B41J 2/01

[52] U.S. Cl. ..... 428/216; 428/195; 428/478.2; 428/480; 428/500; 428/520; 428/532

[58] Field of Search ..... 428/195, 480, 428/500, 520, 532, 478.2, 213–216

[56] References Cited

U.S. PATENT DOCUMENTS

| | | | |
|---|---|---|---|
| 4,956,225 | 9/1990 | Malhotra | 428/216 |
| 4,997,697 | 3/1991 | Malhotra | 428/195 |
| 5,118,570 | 6/1992 | Malhotra | 428/474.4 |
| 5,202,205 | 4/1993 | Malhotra | 430/17 |
| 5,212,008 | 5/1993 | Malhotra et al. | 428/500 |
| 5,244,714 | 9/1993 | Malhotra et al. | 428/195 |

*Primary Examiner*—Pamela R. Schwartz
*Attorney, Agent, or Firm*—E. O. Palazzo

[57] ABSTRACT

A transparency comprised of a supporting substrate, thereover a first coating layer comprised of a binder having a glass transition temperature of less than about 55° C., a cellulosic viscosity modifier, a lightfastness inducing agent and a biocide; and a second ink-receiving coating layer comprised of a hydrophilic binder, an oxyalkylene containing compound, a dye mordant, an optional filler, and an optional biocide; and wherein the first coating is in contact with the substrate and is situated between the substrate and the second ink coating, and which transparency possesses a haze value of from about 1 to about 10 and a lightfastness value of from about 70 to about 95.

29 Claims, No Drawings

INK JET TRANSPARENCIES

BACKGROUND OF THE INVENTION

The present invention is directed to transparencies, and more specifically, to low haze light fast ink jet transparencies. In embodiments of the present invention, the transparencies are comprised of a supporting substrate and thereover two coatings, a first acrylic latex coating and a second nonionic cellulose ink receiving layer, and preferably wherein two coatings are present on each surface of the supporting substrate. With the transparencies of the present invention, there are enabled a number of advantages, including the important advantage of low haze, that is, for example, wherein the transparencies permit 95 percent of the light to be transmitted therethrough in embodiments, and which transparencies possess excellent lightfastness characteristics. The transparencies of the present invention can be selected for ink jet methods and apparatus.

U.S. Pat. No. 5,118,570 and U.S. Pat. No. 5,006,407, the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 5,145,749 discloses erasable coatings for xerography paper which comprise a pigment, such as calcium carbonate, in a binder such as an aqueous emulsion of an acrylic polymer. The erasability of the coating is improved by replacing at least 15 weight percent of the binder with a polyalkane or polyalkene wax, such as an aqueous emulsion of a polyolefin.

U.S. Pat. No. 4,526,847 discloses a transparency for the formation of an adherent electrostatic image thereon which includes a polyester resin film sheet having an image-receiving coating of nitrocellulose, a plasticizer, a particulate material, and preferably an antistatic agent. The coating is applied to the film sheet from a solvent mixture of an aliphatic ester or an aliphatic ketone, and an aliphatic alcohol.

U.S. Pat. No. 3,561,337 discloses a sheet material having a transparent backing coated with a layer containing a polymeric binder and particles of solid material which is insoluble in the binder. The refractive index of the solid material varies, for example, from that of the binder by at most ±0.6. The surface of the layer is ink receptive and, by printing on that surface, a transparency is obtained.

U.S. Pat. No. 4,956,225 discloses a transparency suitable for electrographic and xerographic imaging which comprises a polymeric substrate with a toner receptive coating on one surface thereof comprising blends selected from the group consisting of poly(ethylene oxide) and carboxymethyl cellulose; poly(ethylene oxide), carboxymethyl cellulose, and hydroxypropyl cellulose; poly(ethylene oxide) and vinylidene fluoride/hexafluoropropylene copolymer; poly (chloroprene) and poly(alpha-methylstyrene); poly (caprolactone) and poly(alpha-methylstyrene); poly(vinyl isobutyl ether) and poly(alpha-methylstyrene); poly (caprolactone) and poly(p-isopropyl alpha-methylstyrene); blends of poly(1,4-butylene adipate) and poly(alpha-methylstyrene); chlorinated poly(propylene) and poly (alpha-methylstyrene); chlorinated poly(ethylene) and poly (alpha-methylstyrene); and chlorinated rubber and poly (alpha-methylstyrene).

U.S. Pat. No. 4,997,697 discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205, the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds, both with polymers containing oxyalkylene segments.

U.S. Pat. No. 5,212,008, the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly (aziridine), poly(acrylamide), poly(N,N-dimethyl acrylamide), acrylamide-acrylic acid copolymer, poly(2-acrylamido-2-methyl propane sulfonic acid), poly(N,N-dimethyl-3,5-dimethylene piperidinium chloride), poly (methyleneguanidine) hydrochloride, poly(ethylene imine) poly(ethylene imine) epichiorohydrin, poly(ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly(alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, imidazoline quaternary compounds, alkyl benzyl dimethyl quaternary compounds, poly(epiamines), and mixtures thereof.

U.S. Pat. No. 5,244,714, the disclosure of which is totally incorporated herein by reference, discloses a recording sheet which comprises a base sheet, an antistatic layer coated on at least one surface of the base sheet comprising a mixture of a first component selected from the group consisting of hydrophilic polysaccharides and a second component selected from the group consisting of poly(vinyl amines), poly(vinyl phosphates), poly(vinyl alcohols), poly(vinyl alcohol)-ethoxylated, poly(ethylene imine)-ethoxylated, poly(ethylene oxides), poly(n-vinyl acetamide-vinyl sulfonate salts), melamine-formaldehyde resins, ureaformaldehyde resins, styrene-vinylpyrrolidone copolymers, and mixtures thereof, and at least one toner receiving layer coated on an antistatic layer comprising a material selected from the group consisting of maleic anhydride containing polymers, maleic ester containing polymers, and mixtures thereof.

Copending application U.S. Ser. No. 208,317, the disclosure of which is totally incorporated herein by reference, discloses a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; and (b) causing droplets of the ink to be ejected in an imagewise pattern onto a surface of the recording sheet containing microspheres, thereby generating images on the recording sheet. Also disclosed is a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, inkreceiving coating layer and the substrate, said second, ink-receiving layer comprising a hydrophilic binder and microspheres; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

Copending application U.S. Ser. No. 444,477, the disclosure of which is totally incorporated herein by reference, discloses a recording sheet which comprises a substrate and a material selected from the group consisting of monosaccharides, oligosaccharides, and mixtures thereof.

U.S. Pat. No. 5,589,277, the disclosure of which is totally incorporated herein by reference, discloses a recording sheet which comprises a paper substrate and a material selected from the group consisting of monomeric amino acids, monomeric hydroxy acids, monomeric polycarboxyl compounds, and mixtures thereof.

Copending application U.S. Ser. No. 196,607, the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 196,676, the disclosure of which is totally incorporated herein by reference, discloses a recording sheet which comprises a substrate and an additive material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof.

Copending application U.S. Ser. No. 196,933, the disclosure of which is totally incorporated herein by reference, discloses a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Also disclosed is a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

Copending application U.S. Ser. No. 196,605, the disclosure of which is totally incorporated herein by reference, discloses a recording sheet which comprises a substrate, an image receiving coating, and a biocide.

The disclosures of each of the patents and applications recited herein are totally incorporated herein by reference in their entirety.

While the above transparencies are suitable for their intended purposes, a need remains for improved transparencies particularly suitable for use in ink jet and electrophotographic applications. In addition, a need remains for transparencies with excellent low haze characteristics, such as haze between from about 1 to about 10 and preferably between 1 to 4, and excellent lightfastness in the range of from about 70 to about 95 percent, a feature not easily obtained considering that the total thickness of the two layered coatings can range from 2 to 50 microns and average about 25 microns. There is also a need for improved ink jet transparencies, and a need for transparencies wherein colors can be satisfactorily projected. A need also remains for transparencies which are particularly suitable for use in printing processes wherein the recorded transparencies are imaged with liquid inks and dried by exposure to microwave radiation. Further, there is a need for transparencies coated with a discontinuous, porous film. There is also a need for transparencies which, subsequent to being imaged with an aqueous ink, exhibit reduced curling. These and other needs are achievable with the transparencies of the present invention in embodiments thereof.

SUMMARY OF THE INVENTION

It is an object of the present invention to provide transparencies with many of the advantages illustrated herein.

It is another object of the present invention to provide transparencies particularly suitable for use in electrophotographic applications, such as ink jet.

It is yet another object of the present invention to provide transparencies with low haze characteristics, such as from about 1 to about 10, and wherein the color gamut is acceptable and does not substantially change.

Moreover, another object of the present invention is to provide transparencies with the combination of excellent lightfastness properties, such as from about 70 to about 95, and low haze characteristics, such as from about 1 to about 10 and preferably from about 1 to about 5, wherein the color gamut is acceptable and does not substantially change.

These and other objects of the present invention can be accomplished in embodiments thereof by providing transparencies with coatings thereover. More specifically, the transparencies of the present invention are comprised of a supporting substrate, a first coating layer thereover of an acrylic latex of, for example, the acrylic emulsion Rhoplex B-15J, obtained from Rohm and Hass Company, and a second coating thereover of blends of nonionic celluloses, such as hydroxypropyl methyl cellulose, and wherein said first and second coatings are present on both surfaces of the transparency. To coat the two or four layers simultaneously in one operation using a two slot die, viscosity modifying polymers may be incorporated in the first coating. Furthermore, to protect ink jet images from sunlight, UV absorbers, antioxidants, and/or antiozonants may be incorporated in the first coating. Additionally, to protect the latex coatings from bacterial degradation, appropriate biocides are incorporated in the first coating composition. The second ink receiving layer contains ink absorbing polymers, such as hydroxypropyl methyl cellulose K35LV, obtained from Dow Chemical Company, ink spreading agents, such as oxyalkylene-containing polymers, such as polyethyleneoxide, POLY OX WSRN-3000™, obtained from Union Carbide Corporation, and a dye mordant to fix the dye in the second coating layer, such as polymethyl acrylate trimethyl ammonium chloride latex, such as HX42-1, obtained from Interpolymer Corporation.

Examples of substrate materials include polyesters, including MYLAR™, available from E. I. Du Pont de Nemours & Company, MELINEX™, available from Imperial Chemicals, Inc., CELANAR™, available from Celanese Corporation, polyethylene naphthalates, such as Kaladex PEN films, available from Imperial Chemical Industries, polycarbonates, such as LEXAN™, available from General Electric Company, polysulfones, such as those available from Union Carbide Corporation, polyether sulfones, such as those prepared from 4,4'-diphenyl ether, such as UDEL™, available from Union Carbide Corporation, those prepared from disulfonyl chloride, such as VICTREX™, available from ICI Americas Incorporated, those prepared from biphenylene, such as ASTREL™, available from 3M Company, poly(arylene sulfones), such as those prepared from crosslinked poly(arylene ether ketone sulfones), cellulose triacetate, polyvinylchloride cellophane, polyvinyl fluoride, polyimides, and the like, with polyester, such as MYLAR™, being preferred in view of its availability and relatively low cost. The substrate can also be opaque, including opaque plastics, such as TESLIN™ available from PPG Industries, and filled polymers, such as MELINEX® available from ICI, with fillers such as oxides.

The substrate, which preferably includes two coatings thereon, and two coatings thereunder in contact with the substrate, can be of any effective thickness. Typical thicknesses for the substrate are from about 50 to about 500 microns, and preferably from about 100 to about 125 microns, although the thickness may be outside these ranges.

The first layer coating composition, which comprises a binder especially an adhesive binder having a glass transition temperature less than about 55° C. and, more specifically, between 10° to 54° C. and preferably 25° to 45° C., a cellulosic viscosity modifier, a lightfastness inducing agent, and a biocide which is present on the front side of the substrate of the multilayered transparency of the present invention in any effective thickness. Typically, the total thickness of this first coating layer is from about 0.1 to about 25 microns and preferably from about 0.5 to 10 microns, although the thickness can be outside of these ranges. In the first coating composition, the binder can be present within the coating in any effective amount; typically the binder or mixtures thereof are present in amounts of from about 20 percent by weight to about 90 percent by weight although the amounts can be outside of this range. The cellulosic viscosity modifiers are present in amounts of from about 20 percent by weight to about 90 percent by weight although the amounts can be outside of this range. The lightfastness inducing agent or mixture thereof are present in the first coating composition in amounts of from about 0.5 percent by weight to about 20 percent by weight, although the amounts can be outside of this range. The biocide compounds or mixture thereof are present in the first coating composition in amounts of from about 0.001 percent by weight to about 3 percent by weight, although the amounts can be outside of this range.

The aforementioned amounts can be determined, for example, as follows:

Various blends of the binder, viscosity modifier, lightfastness inducing agent, and the biocide were made in water and coated on to a polyester sheet to yield transparencies with a single layer thereover and thereunder. After drying the polyester sheet at 100° C., these were tested for coating adhesion to a polyester, printed with a Xerox Corporation ink jet test fixture to, for example, check print quality, drying times of the images, lightfastness and intercolor bleed. The data was analyzed statistically for optimum range of compositions. A preferred composition range for the first layer coating of the transparency is the binder present in amounts of from about 20 percent by weight to about 50 percent by weight, the viscosity modifier present in an amount of from about 78 percent by weight to about 37 percent by weight, the lightfastness inducing agent or mixtures thereof present in amounts of from about 1.9 percent by weight to about 10 percent by weight, and the biocide compounds or mixtures thereof present in amounts of from about 0.1 percent by weight to about 3 percent by weight; (20+78+1.9+0.1) to (50+37+10+3).

The preferred composition for the first layer coating of the transparency is 35.0 percent by weight of the binder, such as acrylic emulsion Rhoplex B-15J, from Rohm and Haas Company, 60.0 percent by weight of the viscosity modifier, such as hydroxyethyl methyl cellulose (HEM, available from British Celanese Ltd.), 4 percent by weight of a lightfastness inducing agent, such as the UV absorbing compound poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company), and 1 percent by weight of the biocide compound, such as 2-hydroxypropylmethane thiosulfonate (Busan 1005, available from Buckman Laboratories Inc.).

Embodiments of the present invention include a transparency comprised of a supporting substrate, thereover and thereunder a first coating layer comprised of a binder having a glass transition temperature in the range of from about 10° to about 54° C., a cellulosic viscosity modifier, a lightfastness inducing agent and a biocide, and wherein said binder is present in an amount of from about 20 percent by weight to about 50 percent by weight, the viscosity modifier is present in an amount of from about 78 percent by weight to about 37 percent by weight, the lightfastness inducing agent is present in an amount of from about 1.9 percent by weight to about 10 percent by weight, and the biocide compound is present in an amount of from about 0.1 percent by weight to about 3 percent by weight; and a second ink-receiving coating layer thereover and thereunder comprised of a blend of a hydrophilic binder, an oxyalkylene containing compound, a dye mordant, filler, antistatic agent, and biocide, and wherein the binder is present in an amount of from about 20 percent by weight to about 67.9 percent by weight, the oxyalkylene containing compound is present in an amount of from about 37 percent by weight to about 20 percent by weight, the dye mordant is present in an amount of from about 30 percent by weight to about 10 percent by weight, the filler is present in an amount of from about 5 to about 1 percent by weight, the antistatic agent is present in an amount of from about 5 to about 1 percent by weight, and the biocide is present in an amount of from about 3 to about 0.1 percent by weight, and wherein the first coating is in contact with the substrate and is situated between the substrate and the second ink coating, and which transparency possesses a haze value of from about 1 to about 10 and a lightfastness value of from about 70 to about 95; and a transparency wherein the binder of the first coating layer is water soluble binders selected from the group consisting of (1) melamine-formaldehyde resin, (2) urea-formaldehyde resin, (3) alkylated urea-formaldehyde resins, (4) vinyl methyl ether-maleic anhydride copolymer, (5) ethylene-maleic anhydride copolymers, (6) butadiene-maleic acid copolymers, (4) octadecene-1-maleic anhydride copolymer, (7) polyvinylmethylether, (8) vinylmethylether-maleic acid copolymer, (9) methyl vinyl ether-maleic acid ester; and mixtures thereof. Typically, when two water soluble binders are mixed together they are present in the range of 25 percent of one and 75 percent of the other, or 75 percent of one and 25 percent of the other.

One embodiment of the present invention includes a transparency with a first layer coating of a thickness of 5 microns, and is comprised of 35.0 percent by weight of the acrylic emulsion Rhoplex B-15J, from Rohm and Haas Company, 60.0 percent by weight of the viscosity modifier hydroxyethyl methyl cellulose (HEM, available from British Celanese Ltd.), or other similar known viscosity modifiers, 4 percent by weight of a lightfastness inducing UV absorbing compound poly[N,N-bis(2,2,6,6-tetramethyl-4-piperidinyl)- 1,6-hexanediamine-co-2,4-dichloro-6-morpholino-1,3,5-triazine] (Cyasorb UV-3346, #41,324-0, available from Aldrich Chemical Company), and 1 percent by weight of the biocide compound 2-hydroxypropylmethane thiosulfonate (Busan 1005, available from Buckman Laboratories Inc.); and a second 10 micron thick ink receiving layer situated on the top of the 5 micron thick first layer comprised of 50 percent by weight of hydroxypropyl methyl cellulose (Methocel K35LV, available from Dow Chemical Company), 25 percent by weight of poly(ethylene oxide), POLY OX WSRN-3000™, available from Union Carbide Corporation, and 25 percent by weight of a polymethyl acrylate trimethyl ammonium chloride latex, HX42-1, available from Interpolymer Corporation. This transparency has a haze value of 3, and lightfast values of greater than 90 percent.

Examples of the first layer polymers in contact with both lateral surfaces of the substrate include water dispersible polymers such as (A) Latex polymers—polymers capable of forming a latex includes, for example, a polymer that forms in water or in an organic solvent, such as toluene, acetone, dichloromethane, or an aliphatic alcohol, and wherein typically the organic solvent is present in an amount of from about 10 to about 30 percent by weight; a stable colloidal system in which the dispersed phase is polymeric. Examples of suitable latex-forming polymers include rubber latex, such as NEOPRENE™ available from Serva Biochemicals, polyester latex, such as Eastman AQ 29D available from Eastman Chemical Company, vinyl chloride latex, such as Geon 352 from B. F. Goodrich Chemical Group, ethylene-vinyl chloride copolymer emulsions, such as Airflex ethylene-vinyl chloride from Air Products and Chemicals, polyvinyl acetate homopolymer emulsions, such as Vinac from Air Products and Chemicals, carboxylated vinyl acetate emulsion resins, such as Synthemul synthetic resin emulsions 40-502, 40-503, and 97-664 from Reichhold Chemicals Inc., and Polyco 2149, 2150, and 2171 from Rohm and Haas Company, vinyl acetate copolymer latex, such as 76 RES 7800 from Union Oil Chemicals Divisions, and Resyn 25-1103, Resyn 25-1109, Resyn 25-1119, and Resyn 25-1189 from National Starch and Chemical Corporation, ethylene-vinyl acetate copolymer emulsions, such as Airflex ethylene-vinyl acetate from Air Products and Chemicals Inc., acrylic-vinyl acetate copolymer emulsions, such as Rhoplex AR-74 from Rohm and Haas Company, Synthemul 97-726 from Reichhold Chemicals Inc., Resyn 25-1140, 25-1141, 25-1142, and Resyn-6820 from National Starch and Chemical Corporation, vinyl acrylic terpolymer latex, such as 76 RES 3103 from Union Oil Chemical Division and Resyn 25-1110 from National Starch and Chemical Corporation, acrylic emulsion latex, such as Rhoplex B-15J, Rhoplex P-376, Rhoplex TR-407, Rhoplex E-940, Rhoplex TR-934, Rhoplex TR-520, Rhoplex HA-24, and Rhoplex NW-1825 from Rohm and Haas Company and Hycar 2600 X 322, Hycar 2671, Hycar 2679, Hycar 26120, and Hycar 2600 X347 from B. F. Goodrich Chemical Group, polystyrene latex, such as DL6622A, DL6688A, and DL6687A from Dow Chemical Company, styrene-butadiene latexes, such as 76 RES 4100 and 76 RES 8100 available from Union Oil Chemicals Division, Tylac resin emulsion 68-412, Tylac resin emulsion 68-067, 68-319, 68-413, 68-500, 68-501, available from Reichhold Chemical Inc., and DL6672A, DL6663A, DL6638A, DL6626A, DL6620A, DL615A, DL617A, DL620A, DL640A, DL650A From Dow Chemical Company, butadiene-acrylonitrile latex, such as Hycar 1561 and Hycar 1562 from B. F. Goodrich Chemical Group, and Tylac Synthetic Rubber Latex 68-302 from Reichhold Chemicals Inc., butadiene-acrylonitrile-styrene terpolymer latex, such as Tylac synthetic rubber latex 68-513 from Reichhold Chemicals inc., mixtures thereof, and the like.

(B) Water soluble polymer examples for the first layer include (the following polymers are considered water soluble whereas the above mentioned latex polymers are generally considered to be water dispersible) such as formaldehyde resins, such as melamine-formaldehyde resin, such as BC 309, available from British Industrial Plastics Limited, urea-formaldehyde resin, such as BC777, available from British Industrial Plastics Limited, and alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as methylated urea-formaldehyde resins, available from American Cyanamid Company as Beetle 65; maleic anhydride and maleic acid containing polymers, such as vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as vinyl methyl ether-maleic anhydride copolymer #173, available from Scientific Polymer Products, alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as ethylene-maleic anhydride copolymer #2308, available from Poly Sciences inc., also available as EMA from Monsanto Chemical Company, butadiene-maleic acid copolymers, such as #07787, available from Poly Sciences Inc., octadecene-1-maleic anhydride copolymer, such as #573 available from Scientific Polymer Products, vinylalkylether homopolymer, such as polyvinylmethylether #025 available from Scientific Polymer Products, and vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as vinylmethylether-maleic acid copolymer, available from GAF Corporation as Gantrez S-95, and alkyl vinyl ethermaleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as methyl vinyl ether-maleic acid ester #773, available from Scientific Polymer Products.

Examples of suitable cellulosic viscosity modifiers of the first layer coatings include hydrophilic polysaccharides and their modifications, such as (1) starch, such as starch SLS-280, available from St. Lawrence starch), (2) cationic starch, such as Cato-72, available from National Starch), (3) hydroxyalkyl starch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like, such as hydroxypropyl starch (#02382, available from Poly Sciences Inc., and hydroxyethyl starch (#06733, available from Poly Sciences Inc.), (4) gelatin, such as Calfskin Gelatin #00639, available from Poly Sciences Inc., (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably From 1 to about 7 carbon atoms, such as methyl, ethyl, propyl, butyl, pentyl, hexyl, benzyl, and the like, such as methyl cellulose (Methocel AM 4, available from Dow Chemical Company), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably From 1 to about 10 carbon atoms, such as methyl, ethyl, propyl, butyl, pentyl, hexyl, benzyl, or the like, such as hydroxyethyl cellulose, Natrosol 250 LR, available from Hercules Chemical Company, and hydroxypropyl cellulose (Klucel Type E, available from Hercules Chemical Company), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as ethyl hydroxyethyl cellulose, Bermocoll, available from Berol Kem. A. B. Sweden, (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose, such as HBMC, available from Dow Chemical Company, (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as dihydroxypropyl cellulose, which can be prepared by the reaction of 3-chloro-1,2-propane with alkali cellulose, (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxypropyl hydroxyethyl cellulose, available from Aqualon Company, (11) halodeoxycellulose, wherein halo represents a halogen atom, such as chlorodeoxycellulose, which can be prepared by the reaction of cellulose with sulfuryl chloride in pyridine at 25° C., (12) amino deoxycellulose, which can be prepared by the reaction of chlorodeoxy cellulose with 19 percent alcoholic solution of ammonia for 6 hours at 160° C., (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as diethylammonium chloride hydroxy ethyl cellulose, available as Celquat H-100, L-200, National Starch and Chemical Company, (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as hydroxypropyl trimethyl ammonium chloride hydroxyethyl cellulose, available from Union Carbide Company as Polymer Jr, (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl amino ethyl cellulose, available from Poly Sciences Inc. as DEAE cellulose #05178, (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, such as carboxymethyl dextrans, available from Poly Sciences Inc. as #16058, (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl aminoethyl dextran, available from Poly Sciences Inc. as #5178, (18)

amino dextran (available from Molecular Probes Inc.), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethyl cellulose CMC 7HOF, available from Hercules Chemical Company, (20) gum arabic, such as #G9752, available from Sigma Chemical Company, (21) carrageenan, such as #C1013 available from Sigma Chemical Company, (22) karaya gum, such as #G0503, available from Sigma Chemical Company, (23) xanthan, such as KeltroI-T, available from Kelco division of Merck and Company, (24) chitosan, such as #C3646, available from Sigma Chemical Company, (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as carboxymethyl hydroxyproyl guar, available from Auqualon Company, (26) cationic guar, such as Celanese Jaguars C-14-S, C-15, C-17, available from Celanese Chemical Company, (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as dimethyl ammonium hydrolyzed collagen protein, available from Croda as Croquats, (29) agar-agar, such as that available from Pfaltz and Bauer Inc, (30) cellulose sulfate salts, wherein the cation is any conventional cation, such as sodium, lithium, potassium, calcium, magnesium, or the like, such as sodium cellulose sulfate #023 available from Scientific Polymer Products, and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethylhydroxyethyl cellulose CMHEC 43H and 37L available from Hercules Chemical Company.

The lightfastness inducing agents of the first layer coating of the present invention include UV absorbing compounds including 2-(4-benzoyl-3-hydroxyphenoxy)ethylacrylate (Cyasorb UV-416, #41,321-6, available from Aldrich Chemical Company), 1,2-hydroxy-4-(octyloxy) benzophenone (Cyasorb UV-531, #41,315-1, available from Aldrich Chemical Company), poly[2-(4-benzoyl-3-hydroxyphenoxy)ethylacrylate] (Cyasorb UV-2126, #41,323-2, available from Aldrich Chemical Company), hexadecyl 3,5-di-tert-butyl-4-hydroxy-benzoate (Cyasorb UV-2908, #41,320-8, available from Aldrich Chemical Company), poly[N,N-bis(2,2,6,6-tetramethyl-4-piperidinyl) -1,6-hexanediamine-co-2,4-dichloro-6-morpholino- 1,3,5-triazine] (Cyasorb UV-3346, #41,324-0, available from Aldrich Chemical Company), 2-dodecyI-N-(2,2,6,6-tetramethyl-4-piperidinyl) succinimide (Cyasorb UV-3581, #41,317-8, available from Aldrich Chemical Company), 2-dodecyl-N-(1,2,2,6,6-pentamethyl-4-piperidinyl) succinimide (Cyasorb UV-3604, #41,318-6, available from Aldrich Chemical Company), N-(1-acetyl-2,2,6,6-tetramethyl-4-piperidinyl)-2-dodecylsuccinimide (Cyasorb UV-3668, #41,319-4, available from Aldrich Chemical Company), 1-[N-[poly(3-allyloxy-2-hydroxypropyl)-2-aminoethyl]-2-imidazolidinone](#41,026-8, available from Aldrich Chemical Company), and poly(2-ethyl-2-oxazoline) (#37,284-6, #37,285-4, #37,397-4, available from Aldrich Chemical Company). The lightfastness inducing agents of the present invention include antioxidant and antiozonant compounds such as 2,2'-methylenebis(6-tert-butyl-4-methylphenol) (Cyanox 2246, #41,315-5, available from Aldrich Chemical Company), 2,2'-methylenebis(6-tert-butyl-4-ethylphenol) (Cyanox 425, #41,314-3, available from Aldrich Chemical Company), tris(4-tert-butyl-3-hydroxy-2,6-dimethylbenzyl)isocyanurate (Cyanox 1790, #41,322-4, LTDP, #D12,840-6, available from Aldrich Chemical Company), didodecyl 3,3'-thiodipropionate (Cyanox LTDP, #D12,840-6, available from Aldrich Chemical Company), ditridecyl 3,3'-thiodipropionate (Cyanox 711, #41,311-9, available from Aldrich Chemical Company), ditetradecyl 3,3'-thiodipropionate (Cyanox MTDP, #41,312-7, available from Aldrich Chemical Company), ditoctadecyl 3,3'-thiodipropionate (Cyanox STDP, #41,310-0, available from Aldrich Chemical Company), 1,3,5-trimethyl-2,4,6-tris (3,5-di-tert-butyl-4-hydroxybenzyl)benzene (Ethanox 300, #41,328-3, available from Aldrich Chemical Company), and 2,6-ditert-butyl-4-(dimethylaminomethyl)phenol (Ethanox 703, #41,327-5, available from Aldrich Chemical Company).

Examples of suitable biocides include (A) nonionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis(thiocyanate) (Metasol T-10, available from Calgon Corporation; AMA-110, available from Vinings Chemical Company; VICHEM MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyano-butane (Metasol CB- 210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1,3,5-thiadiazine-2-thione (Slime-Trol RX-28, available from Betz Paper Chem Inc.; Metasol D3T-A, available from Calgon Corporation; Slime Arrest, available from Western Chemical Company); (10) a nonionic blend of a sulfone, such as bis(trichloromethyl) sulfone and methylene bisthiocyanate available as Slime-Trol RX-38A from Betz Paper Chem Inc.); (11) a nonionic blend of methylene bisthiocyanate and bromonitrostyrene (available as Slime-Trol RX-41 from Betz Paper Chem Inc.); (12) a nonionic blend of 2-(thiocyanomethylthio) benzothiazole (53.2 percent by weight) and 2-hydroxypropyl methanethiosulfonate (46.8 percent by weight) (available as Busan 25 from Buckman Laboratories Inc.); (13) a nonionic blend of methylene bis(thiocyanate), 50 percent by weight, and 2-(thiocyanomethylthio)

benzothiazole, 50 percent by weight, (available as Busan 1009, 1009WB from Buckman Laboratories Inc.); (14) a nonionic blend of 2-bromo-4'-hydroxyacetophenone, 70 percent by weight, and 2-(thiocyanomethylthio) benzothiazole, 30 percent by weight, (Busan 93, available from Buckman Laboratories Inc.); (15) a nonionic blend of 5-chloro-2-methyl-4-isothiazoline-3-one, 75 percent by weight, and 2-methyl-4-isothiazolin-3-one, 25 percent by weight), (available as Amerstat 250 from Drew Industrial Division; Nalcon 7647, from Nalco Chemical Company; Kathon LX, from Rohm and Haas Co.); and the like, as well as mixtures thereof; (B) anionic biocides, such as 1) anionic potassium N-hydroxymethyl-N-methyl-dithiocarbamate available as Busan 40 from Buckman Larboratories Inc.); (2) an anionic blend of N-hydroxymethyl-N-methyl dithiocarbamate, 80 percent by weight, and sodium 2-mercapto benzothiazole, 20 percent by weight, (available as Busan 52 from Buckman Laboratories Inc.); (3) an anionic blend of sodium dimethyl dithiocarbamate, 50 percent by weight and disodium ethylenebisdithiocarbamate, 50 percent by weight, (available as Metasol 300 from Calgon Corporation; Amerstat 272 from Drew Industrial Division; Slime Control F from Western Chemical Company); (4) an anionic blend of N-methyldithiocarbamate, 60 percent by weight, and disodium cyanodithioimidocarbonate, 40 percent by weight, (available as Busan 881 from Buckman Laboratories Inc); (5) an anionic blend of methylene bisthiocyanate, 33 percent by weight, sodium dimethyldithiocarbamate, 33 percent by weight, and sodium ethylene bisdithiocarbamate, 33 percent by weight, (available as Amerstat 282 from Drew Industrial Division; AMA-131 from Vinings Chemical Company); (6) sodium dichlorophene (G-4-40, available from Givaudan Corporation); and the like, as well as mixtures thereof; (C) cationic biocides, such as (1) cationic poly(oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as Slime-Trol RX-31, RX-32, RX-32P, RX-33, from Betz Paper Chem Inc.); (3) a cationic blend of a sulfone, such as bis(trichloromethyl) sulfone and a quaternary ammonium chloride (available as Slime-Trol RX-36 DPB-865 from Betz Paper Chem. Inc.); (4) a cationic blend of methylene bisthiocyanate and chlorinated phenols (available as Slime-Trol RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

The second ink-receiving coating layer situated in each instance so that the first coating layer is between the second ink-receiving coating layer and the substrate, said second ink-receiving layer comprising a hydrophilic binder, an oxyalkylene containing compound and a dye mordant, and wherein the second coating layer is present on the first coating layer of the multilayered transparency of the present invention in any effective thickness. Typically, the total thickness of the second coating layer is from about 0.1 to about 25 microns and preferably from about 0.5 to 10 microns, although the thickness can be outside of these ranges.

In the second coating composition present on both surfaces of the substrate, as is the situation with the first coating, the binder can be present within the coating in any effective amount; typically the binder is present in amounts of from about 20 percent by weight to about 90 percent by weight although the amounts can be outside of this range. The oxyalkylene containing compounds are present in amounts of from about 20 percent by weight to about 90 percent by weight although the amounts can be outside of this range. The dye mordants are present in the second coating composition in amounts of from about 0.5 percent by weight to about 30 percent by weight although the amounts can be outside of this range. The optional filler, if present, ranges in amounts of from between 1 to 5 percent by weight although the amounts can be outside of this range. The optional antistatic agent, if present, ranges in amounts of between 1 to 5 percent by weight although the amounts can be outside of this range. The optional biocide, if present, ranges in amounts of between 0.1 to 3 percent by weight although the amounts can be outside of this range.

A preferred composition range for the second layer coating of the transparency is the binder or mixtures thereof present in amounts of from about 20 percent by weight to about 67.9 percent by weight, the oxyalkylene containing compounds present in amounts of from about 37 percent by weight to about 20 percent by weight, the dye mordants or mixture thereof are present in amounts of from about 30 percent by weight to about 10 percent by weight, and the filler in amounts of between 5 to 1 percent by weight. The antistatic agent ranges in amounts of between 5 to 1 percent by weight. The biocide ranges in amounts of between 3 to 0.1 percent by weight although the amounts can be outside of this range.

Examples of suitable binder polymers for the second coating include (a) hydrophilic polysaccharides and their modifications, or derivatives thereof, such as (1) starch, such as starch SLS-280, available from St. Lawrence Starch, (2) cationic starch, such as CATO-72, available from National Starch, (3) hydroxyalkyl starch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like, such as hydroxypropyl starch, #02382, available from Poly Sciences Inc. and hydroxyethyl starch, #06733, available from Poly Sciences Inc., (4) gelatin, such as Calfskin Gelatin, #00639, available from Poly Sciences Inc., (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like, such as methyl cellulose, MethoceL AM 4, available from Dow Chemical Company, and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as hydroxyethyl cellulose (Natrosol 250 LR, available from Hercules Chemical Company), and hydroxypropyl cellulose (Klucel Type E, available from Hercules Chemical Company), (7) alkyl hydroxy alkyl celluloses, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as ethyl hydroxyethyl cellulose, Bermocoll, available from Berol Kern. A. B. Sweden, (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose, such as HBMC, available from Dow Chemical Company, (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as dihydroxypropyl cellulose, which can be prepared by the reaction of 3-chloro-1,2-propane with alkali cellulose, (10) hydroxy alkyl hydroxy alkyl cellulose, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxypropyl hydroxyethyl cellulose, available from Aqualon Company, (11) halodeoxycellulose, wherein halo represents a halogen atom, such as chlorodeoxycellulose, which can be prepared by the reaction of cellulose with sulfuryl chloride in pyridine at 25° C., (12) amino deoxycellulose, which can be prepared by the reaction of chlorodeoxy cellulose with 19 percent alcoholic solution of ammonia for 6 hours at 160° C., (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as diethylammonium chloride hydroxy ethyl cellulose, available as Celquat H-100, L-200, National Starch and Chemical Company, (14) hydroxyalkyl trialkyl ammonium halide hydroxyalkyl cellulose, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as hydroxypropyl trimethyl ammonium chloride hydroxyethyl cellulose, available from Union Carbide Company as Polymer JR, (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl amino ethyl cellulose, available from Poly Sciences Inc. as DEAE cellulose #05178, (16) carboxyalkyl dextrans, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, such as carboxymethyl dextrans, available from Poly Sciences Inc. as #16058, (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl aminoethyl dextran, available from Poly Sciences Inc. as #5178, (18) amino dextran (available from Molecular Probes Inc.), (19) carboxy alkyl cellulose salts, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethyl cellulose CMC 7HOF, available from Hercules Chemical Company, (20) gum arabic, such as #G9752, available from Sigma Chemical Company, (21) carrageenan, such as #C1013 available from Sigma Chemical Company, (22) karaya gum, such as #G0503, available from Sigma Chemical Company, (23) xanthan0 such as KELTROL-T, available from Kelco division of Merck and Company, (24) chitosan, such as #C3646, available from Sigma Chemical Company, (25) carboxyalkyl hydroxyalkyl guar, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as carboxymethyl hydroxypropyl guar, available from Auqualon Company, (26) cationic guar, such as Celanese Jaguars C-14-S, C-15, C-17, available from Celanese Chemical Company, (27) n-carboxyalkyl chitin, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as dimethyl ammonium hydrolyzed collagen protein, available from Croda as Croquats, (29) agar-agar, such as that available from Pfaltz and Bauer Inc, (30) cellulose sulfate salts, wherein the cation is any conventional cation, such as sodium, lithium, potassium, calcium, magnesium, or the like, such as sodium cellulose sulfate #023 available from Scientific Polymer Products, and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethylhydroxyethyl cellulose CMHEC 43H and 37L available from Hercules Chemical Company; (b) vinyl polymers, such as (1) poly(vinyl alcohol), such as Elvanol available from DuPont Chemical Company), (2) poly(vinyl phosphate), such as #4391 available from Poly Sciences Inc., (3) poly(vinyl pyrrolidone), such as that available from GAF Corporation, (4) vinyl pyrrolidone-vinyl acetate copolymers, such as #02587, available from Poly Sciences Inc., (5) vinyl pyrrolidone-styrene copolymers, such as

#371, available from Scientific Polymer Products, (6) poly (vinylamine), such as #1562, available from Poly Sciences Inc., (7) poly(vinyl alcohol) alkoxylated, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as poly(vinyl alcohol) ethoxylated #6573, available from Poly Sciences Inc., and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as poly(vinyl pyrrolidone-diethylaminomethylmethacrylate), #16294 and #16295, available from Poly Sciences inc.; (c) formaldehyde resins, such as (1) melamine-formaldehyde resin, such as BC 309, available from British Industrial Plastics Limited, (2) urea-formaldehyde resin, such as BC777, available from British Industrial Plastics Limited, and (3) alkylated ureaformaldehyde resins, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as methylated urea-formaldehyde resins, available from American Cyanamid Company as Beetle 65; (d) ionic polymers, such as (1) poly(2- acrylamide-2-methyl propane sulfonic acid), such as #175 available from Scientific Polymer Products, (2) poly (N,N-dimethyl-3,5-dimethylene piperidinium chloride), such as #401, available from Scientific Polymer Products, and (3) poly(methylene-guanidine) hydrochloride, such as #654, available from Scientific Polymer Products; (e) latex polymers, such as (1) cationic, anionic, and nonionic styrene-butadiene latexes, such as that available from Gen Corporation Polymer Products, such as RES 4040 and RES 4100, available from Unocal Chemicals, and such as DL 6672A, DL6638A, and DL6663A, available from Dow Chemical Company, (2) ethylenevinylacetate latex, such as Airflex 400, available from Air Products and Chemicals Inc., (3) vinyl acetate-acrylic copolymer latexes, such as Synthemul 97-726, available from Reichhold Chemical Inc, Resyn 25-1110 and Resyn 25-1140, available from National Starch Company, and RES 3103 available from Unocal Chemicals; (f) maleic anhydride and maleic acid containing polymers, such as (1) styrene-maleic anhydride copolymers, such as that available as Scripset from Monsanto, and the SMA series available from Arco, (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as vinyl methyl ether-maleic anhydride copolymer #173, available from Scientific Polymer Products, (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as ethylene-maleic anhydride copolymer #2308, available from Poly Sciences Inc., also available as EMA from Monsanto Chemical Company, (4) butadiene-maleic acid copolymers, such as #07787, available from Poly Sciences Inc., (5) vinylalkylether-maleic acid copolymers, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as vinylmethylether-maleic acid copolymer, available from GAF Corporation as Gantrez S-95, and (6) alkyl vinyl ether-maleic acid esters, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as methyl vinyl ethermaleic acid ester #773, available from Scientific Polymer Products; (g) acrylamide containing polymers, such as (1) poly(acrylamide), such as #02806, available from Poly Sciences Inc., (2) acrylamide-acrylic acid copolymers, such as #04652, #02220, and #18545, available from Poly Sciences Inc., and (3) poly(N, N-dimethyl acrylamide), such as #004590, available from Poly Sciences Inc.; and (h) poly(alkylene imine) containing polymers, wherein alkylene has two (ethylene), three (propylene), or four (butylene) carbon atoms, such as (1) poly(ethylene imine), such as #135, available from Scientific Polymer Products, (2) poly(ethylene imine) epichlorohydrin, such as #634, available from Scientific Polymer Products, and (3) alkoxylated poly(ethylene imine), wherein alkyl has one (methoxylated), two (ethoxylated), three (propoxylated), or four (butoxylated) carbon atoms, such as ethoxylated poly(ethylene imine #636, available from Scientific Polymer Products.

The oxyalkylene-containing polymers of the second layer in contact with the first layer include poly(oxy methylene), such as #009, available from Scientific Polymer Products, poly(oxyethylene) or poly(ethylene oxide), such as POLY OX WSRN-3000, available from Union Carbide Corporation, ethylene oxide/propylene oxide copolymers, such as ethylene oxide/propylene oxide/ethylene oxide triblock copolymer, such as Alkatronic EGE-31-1, available from Alkaril Chemicals, propylene oxide/ethylene oxide/propylene oxide triblock copolymers, such as Alkatronic PGP 3B-1, available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8, available from BASF Corporation, ethylene oxide/2-hydroxyethyl methacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using $\alpha,\alpha'$-azobisisobutyronitrile as initiator, and reacting the resulting amino-semitelechelic oligo-hydroxyethyl methacrylate or aminohydroxypropyl methacrylate with an isocyanate-polyethylene oxide complex in chlorobenzene at 0° C., and precipitating the reaction mixture in diethylether, filtering and drying in vacuum, ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being carried out in an explosion proof stainless steel reactor, ionene/ethylene oxide/ionene triblock copolymers, which can be synthesized via quaternization reaction of one end of each 3-3 ionene with the halogenated, preferably brominated, poly (oxyethylene) in methanol at about 40° C., ethylene oxide/isoprene/ethylene oxide triblock copolymers, which can be synthesized via anionic polymerization of isoprene with sodium naphthalene in tetrahydrofuran as solvent at −78° C., and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, epichlorohydrin-ethyleneoxide copolymer, such as #155 available from Scientific Polymer Products, as well as mixtures thereof. The preferred oxyalkylene containing polymers are poly(ethylene oxide), poly (propylene oxide), and ethylene oxide/propylene oxide block copolymers because of their availability and lower cost.

The biocide of the second layer can be the same as, or similar to the biocide of the first layer coating. Examples of fillers include colloidal silicas available from W. R. Grace, and such fillers are present in effective amounts to assist in the feeding of the transparency through the printer, for example from about 0.1 to about 10 weight percent, and preferably from 1 to about 5 weight percent.

Examples of the dye mordants include quaternary acrylic copolymer latexes, particularly those of the formula

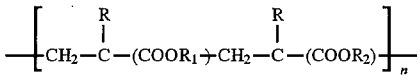

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corporation, or the like; formaldehyde-free GARDOL DR/NF™, available from Apollo Chemical Corporation, poly quaternary amine PERCHEM 553™, available from Chem Link Industrial, poly quaternary amine POLY PLUS 1290™, available from Betz Paper Chem Inc; ARMOSOFT 420-90™, available from Akzo Chemie Chemicals, Mirapol A-15 and MirapoL WT, available from Miranol, Incorporated, Dayton, N.J., prepared as disclosed in U.S. Pat. No. 4,157,388, the disclosure of which is totally incorporated herein by reference, Mirapol AZ-1, available from Miranol, Inc., prepared as disclosed in U.S. Pat. No. 4,719,282, the disclosure of which is totally incorporated herein by reference, Mirapol AD-1, available from Miranol, Inc., prepared as disclosed in U.S. Pat. No. 4, 157,388, Mirapol 9, Mirapol 95, and Mirapol 175, available from Miranol, Inc., Dayton, N.J., prepared as disclosed in U.S. Pat. No. 4,719,282, and the like. Other suitable cationic dye mordants comprise diamino alkanes; quaternary salts; quaternary acrylic copolymer latexes; ammonium quaternary salts as disclosed in U.S. Pat. No. 5,320,902; phosphonium quaternary salts as disclosed in copending application U.S. Ser. No. 08/034,917; and sulfonium, thiazolium and benzothiazolium quaternary salts as disclosed in U.S. Pat. No. 5,314,747, the disclosures of each of which are totally incorporated herein by reference.

The coatings of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25 to about 100° C. in an air dryer.

One embodiment of the present invention includes a transparency where the first layer coating has a thickness of 5 microns and is comprised of 35.0 percent by weight of the acrylic emulsion Rhoplex B-15J, from Rohm and Haas Company, 60.0 percent by weight of the viscosity modifier hydroxyethyl methyl cellulose (HEM, available from British Celanese Ltd.), 4 percent by weight of a lightfastness inducing UV absorbing compound poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company), and 1 percent by weight of the biocide compound 2-hydroxypropylmethane thiosulfonate (Busan 1005, available from Buckman Laboratories Inc.); and a second 10 micron thick ink receiving layer situated on the top of the 5 micron thick first layer comprised of 50 percent by weight of hydroxypropyl methyl cellulose (Methocel K35LV, available from Dow Chemical Company), 25 percent by weight of poly(ethylene oxide), POLY OX WSRN-3000™, available from Union Carbide Corporation, and 25 percent by weight of polymethyl acrylate trimethyl ammonium chloride latex, HX42-1, available from Interpolymer Corporation. This transparency has a haze value of 3, and lightfast values of greater than 90 percent. The transparencies of the present invention in embodiments can also be used in a printing or imaging process, such as printing with pen plotters, handwriting with ink pens, offset printing processes, or the like, provided that the ink employed to form the image is compatible with the ink receiving layer of the recording sheet.

The drying time of images obtained with the transparencies of the present application is the time for zero image-offset and can be measured as follows: a line comprising different color sequences is drawn on the transparency with droplets of inks from an ink jet printhead moving from left to right and back. Thereafter, this image is purposely smeared with the pinch roll of the printer by fast forwarding the transparency mechanically while the pinch roll is on the top of the imaged line. This entire procedure takes about two seconds to complete. In the event that no offset of the printed image on the unprinted paper or transparency occurs, the drying time of the image is considered as less than two seconds.

Transparencies of the present invention in embodiments exhibit reduced curl upon being printed with aqueous inks, particularly in situations wherein the ink image is dried by exposure to microwave radiation. Generally, the term "curl" refers to the distance between the base line of the arc formed by the transparency or recording sheet when viewed in cross-section across its width (or shorter dimension, for example, 8.5 inches in an 8.5×11 inch sheet, as opposed to length, or longer dimension, for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

The transparencies of the present invention in embodiments exhibit little or no blocking. Blocking refers to the transfer of ink or toner from a printed image from one sheet to another when recording sheets are stacked together. The recording sheets of the present invention exhibit substantially no blocking under, for example, environmental conditions of from about 20 to about 80 percent relative humidity and at temperatures of about 80° F.

Further, the transparencies of the present invention in embodiments exhibit high resistance to humidity. Resistance to humidity generally is the capacity of a recording sheet to control the blooming and bleeding of printed images, wherein blooming represents intra-diffusion of dyes and bleeding represents inter-diffusion of dyes. The blooming test can be performed by printing a bold filled letter such as "T" on a recording sheet and placing the sheet in a constant environment chamber preset for humidity and temperature. The vertical and horizontal spread of the dye in the letter "T" is monitored periodically under a microscope. Resistance to humidity limit is established when the dyes selected begin to diffuse out of the letter "T". The bleeding test is performed by printing a checker board square pattern of various different colors and measuring the inter-diffusion of colors as a function of humidity and temperature.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Haze values recited herein were measured by a XL-211 Hazegard Hazemeter supplied by Pacific Scientific Company.

The lightfastness values of the ink jet images were measured in the Mark V Lightfastness Tester obtained from Microscal Company, London, England.

Specific embodiments of the invention will now be described in detail. These Examples are intended to be illustrative, and the invention is not limited to the materials, conditions, or process parameters set forth in these embodiments. The coatings, a total of four, are included on both surfaces or sides of the transparency unless otherwise indicated. All parts and percentages are by weight unless otherwise indicated.

EXAMPLE

Twenty transparency sheets were prepared by the solvent extrusion process (single side each time initially) on a Faustel Coater using a two slot die by providing for each a MYLAR™ base sheet (roll form) with a thickness of 100 microns, and coating the base sheet simultaneously with two hydrophilic polymeric layers where the first layer in contact with the substrate was comprised of a blend comprised of 100 milliliters (35 percent of polymer and 65 percent of water) of acrylic emulsion Rhoplex B-15J, 60 grams of hydroxyethyl methyl cellulose, 4 grams of the lightfastness inducing agent, and 1 gram of the biocide, diluted to 1,675 milliliters of total solution which translates to 5.0 percent by weight of the vinylacrylic emulsion Rhoplex B-15J, from Rohm and Haas Company, 60.0 percent by weight of hydroxyethyl methyl cellulose (HEM, available from British Celanese Ltd.), 4 percent by weight of a lightfastness inducing UV absorbing compound poly[N,N-bis(2,2,6,6-tetramethyl-4-piperidinyl)-1,6-hexanediamine-co-2,4-dichloro-6-morpholino-1,3,5-triazine](Cyasorb UV-3346, #41,324-0, available from Aldrich Chemical Company), and 1 percent by weight of the biocide compound 2-hydroxypropylmethane thiosulfonate (Busan 1005, available from Buckman Laboratories Inc.); which blend was present in a concentration of 6 percent by weight in water and the second layer in contact with the first layer was comprised of a blend of 50 percent by weight of hydroxypropyl methyl cellulose (Methocel K35LV, available from Dow Chemical Company), 25 percent by weight of poly (ethylene oxide), POLY OX WSRN-3000, available from Union Carbide Corporation, and 25 percent by weight of polymethyl acrylate trimethyl ammonium chloride latex, HX42-1, available from Interpolymer Corporation, which blend was present in a concentration of 4 percent by weight in water. Subsequent to air drying at 100° C. and monitoring the difference in weight prior to and subsequent to coating, the dried MYLAR 7. base sheet rolls were coated 1.5 grams in a thickness of 15 microns of the two layered transparency structure. Rewinding the coated side of the MYLAR™ base sheet (roll form) on to an empty core and using these rolls, the uncoated side of the MYLAR™ base sheet were coated on a Faustel Coater using a two slot die simultaneously with two hydrophilic polymeric layers where the first layer in contact with the substrate was a blend of 35.0 percent by weight of the acrylic emulsion latex, Rhoplex B-15J, from Rohm and Haas Company, 60.0 percent by weight of hydroxyethyl methyl cellulose (HEM, available from British Celanese Ltd.), 4 percent by weight of UV absorbing compound poly[N,N-bis(2,2,6,6-tetramethyl-4-piperidinyl)1,6-hexanediamine-co-2,4-dichloro-6-morpholino- 1,3,5-triazine] (Cyasorb UV-3346, #41,324-0, available from Aldrich Chemical Company), and 1 percent by weight of a biocide compound 2-hydroxypropylmethane thiosulfonate (Busan 1005, available from Buckman Laboratories Inc.); which blend was present in a concentration of 6 percent by weight in water and the second layer in contact with the first layer was a blend of 50 percent by weight of hydroxypropyl methyl cellulose (Methocel K35LV, available from Dow Chemical Company), 25 percent by weight of poly(ethylene oxide), of POLY OX WSRN-3000™, available from Union Carbide Corporation, and 25 percent by weight of polymethyl acrylate trimethyl ammonium chloride latex, such as HX42-1, available from Interpolymer Corporation, which blend was present in a concentration of 4 percent by weight in water. Subsequent to air drying at 100° C. and monitoring the difference in weight prior to and subsequent to coating, the dried MYLAR™ base sheet rolls were coated 1.5 grams in a thickness of 15 microns of the two layered transparency structure. The transparency sheets thus prepared had a haze value of 3.

These were incorporated into a Hewlett-Packard 500-C color ink jet printer containing inks of the following compositions:

Cyan: 15.785 percent by weight of sulfolane, 10.0 percent by weight of butyl carbitol, 2.0 percent by weight of ammonium bromide, 2.0 percent by weight of N-cyclohexylpyrrolidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of Dowicil 150 biocide, obtained from Dow Chemical Company, Midland, MI, 0.03 percent by weight of polyethylene oxide (molecular weight 18,500), obtained from Union Carbide Company, 35 percent by weight of Projet Cyan 1 dye, obtained from ICI, and 34.285 percent by weight of deionized water.

Magenta: 15.785 percent by weight of sulfolane, 10.0 percent by weight of butyl carbitol, 2.0 percent by weight of ammonium bromide, 2.0 percent by weight of N-cyclohexylpyrrolidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of Dowicil 150 biocide, obtained from Dow Chemical Company, Midland, MI, 0.03 percent by weight of polyethylene oxide (molecular weight 18,500), obtained from Union Carbide Company, 25 percent by weight of Projet Magenta 1T dye, obtained from ICI, 4.3 percent by weight of Acid Red 52 obtained from Tricon Colors, and 39.985 percent by weight of deionized water.

Yellow: 15.785 percent by weight of sulfolane, 10.0 percent by weight of butyl carbitol, 2.0 percent by weight of ammonium bromide, 2.0 percent by weight of N-cyclohexylpyrrolidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of Dowicil 150 biocide, obtained from Dow Chemical Company, Midland, MI, 0.03 percent by weight of polyethylene oxide (molecular weight 18,500), obtained from Union Carbide Company, 27.0 percent by weight of Projet Yellow 1G dye, obtained from ICI, 20.0 percent by weight of Acid Yellow 17 obtained from Tricon Colors, and 22.285 percent by weight of deionized water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 watts output power at 2450 MHz frequency. The black images were "process black" (i.e., formed by superimposition of cyan, magenta, and yellow images). The resulting images dried in less than 10 seconds and yielded optical density values of 1.90 black, 1.80 cyan, 1.60 magenta and 1.00 yellow. These images had lightfastness values better than 90 percent and, more specifically, about 92 percent average for all colors after a period of six months, and showed no intercolor bleed when retained at a 80 percent humidity at 80° F. for a period of seven days.

EXAMPLE II

Twenty transparency sheets were prepared by the solvent extrusion process (single side each time initially) on a Faustel Coater using a two slot die by providing for each a MYLAR™ base sheet (roll form) with a thickness of 100 microns, and coating the base sheet simultaneously with two hydrophilic polymeric layers where the first layer in contact with the substrate was a blend of 50.0 percent by weight of polyvinylmethylether, #025 available from Scientific Polymer Products, 45.0 percent by weight of hydroxypropyl trimethyl ammonium chloride hydroxyethyl cellulose, available from Union Carbide Company as Polymer Jr, 4 percent by weight of UV absorbing compound poly[N,N-bis(2,2,6,6-tetramethyl-4-piperidinyl)-1,6-hexanediamine-co-2,4-dichloro-6-morpholino- 1,3,5-triazine] (Cyasorb UV-3346, #41,324-0, available from Aldrich Chemical Company), and 1 percent by weight of a biocide compound cationic poly (oxyethylene (dimethylamino)-ethylene (dimethylamino) ethylene dichloride) (Busan 77, available from Buckman Laboratories Inc.), which blend was present in a concentration of 6 percent by weight in water, and the second layer in contact with the first layer was a blend of 50 percent by weight of hydroxy butyl methyl cellulose (HBMC, available from Dow Chemical Company), 25 percent by weight of ethylene oxide/propylene oxide/ethylene oxide triblock copolymer, Alkatronic EGE-31-1, available from Alkaril Chemicals, and 25 percent by weight of hexamethylene bistrimethyl ammonium bromide (Aldrich 21,967-3), which blend was present in a concentration of 4 percent by weight in water. Subsequent to air drying at 100° C. and monitoring the difference in weight prior to and subsequent to coating, the dried MYLAR™ base sheet rolls were coated 1.5 grams in a thickness 15 microns of the two layered transparency structure. Rewinding the coated side of the MYLAR™ base sheet (roll form) on to an empty core and using these rolls the uncoated side of the MYLAR™ base sheet was coated on a Faustel Coater using a two slot die simultaneously with two hydrophilic polymeric layers where the first layer in contact with the substrate was a blend of 50.0 percent by weight of polyvinylmethylether #025 available from Scientific Polymer Products, 45.0 percent by weight of hydroxypropyl trimethyl ammonium chloride hydroxyethyl cellulose, available from Union Carbide Company as Polymer Jr, 4 percent by weight of UV absorbing compound poly[N,N-bis(2,2,6,6-tetramethyl-4-piperidinyl)-1,6-hexanediamine-co-2,4-dichloro-6-morpholino-1,3,5-triazine](Cyasorb UV-3346, #41,324-0, available from Aldrich Chemical Company), and 1 percent by weight of a biocide compound cationic poly(oxyethylene (dimethylamino)-ethylene (dimethylamino) ethylene dichloride) (Busan 77, available from Buckman Laboratories Inc.), which blend was present in a concentration of 6 percent by weight in water, and the second layer in contact with the first layer was a blend of 50 percent by weight of hydroxy butyl methyl cellulose (HBMC, available from Dow Chemical Company), 25 percent by weight of ethylene oxide/propylene oxide/ethylene oxide triblock copolymer Alkatronic EGE-31-1, available from Alkaril Chemicals, and 25 percent by weight of hexamethylene bistrimethyl ammonium bromide (Aldrich 21,967-3), which blend was present in a concentration of 4 percent by weight in water. Subsequent to air drying at 100° C. and monitoring the difference in weight prior to and subsequent to coating, the dried MYLAR™ base sheet rolls were coated 1.5 grams in a thickness 15 microns of the two layered transparency structure. The transparency sheets thus prepared had a haze value of 5.

These transparencies were incorporated into a Hewlett-Packard 500-C color ink jet printer containing the same inks as those used in Example I. Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 watts output power at 2450 MHz frequency. The black images were "process black" (i.e., formed by superimposition of cyan, magenta, and yellow images). The resulting images dried in less than 10 seconds and yielded optical density values of 1.80 black, 1.85 cyan, 1.65 magenta and 1.05 yellow. These images had lightfastness values better than 80 percent and, more specifically, an average of 83 percent for all colors after a period of six months and showed no intercolor bleed when kept at 80 percent humidity at 80° F. for a period of seven days.

EXAMPLE III

Twenty transparency sheets were prepared by the solvent extrusion process (single side each time initially) on a Faustel Coater using a two slot die by providing for each a MYLAR™ base sheet (roll form) with a thickness of 100 microns and coating the base sheet simultaneously with two hydrophilic polymeric layers where the first layer in contact with the substrate was a blend of 50.0 percent by weight of ethylene-vinylacetate latex Airflex from Air Products and Chemicals Inc., 25.0 percent by weight of sodium carboxymethylhydroxyethyl cellulose, CMHEC 37L available from Hercules Chemical Company, 20.0 percent by weight of sodium carboxymethylhydroxyethyl cellulose, CMHEC 43H available from Hercules Chemical Company, 4 percent by weight of UV absorbing compound poly[N,N-bis(2,2,6,6-tetramethyl-4-piperidinyl)- 1,6-hexanediamine-co-2,4-dichloro-6-morpholino-1,3,5-triazine] (Cyasorb UV-3346, #41,324-0, available from Aldrich Chemical Company), and 1 percent by weight of a biocide compound, Kathon LX, from Rohm and Haas Company, which blend was present in a concentration of 6 percent by weight in water, and the second layer in contact with the first layer was a blend of 50 percent by weight of hydroxy propyl methyl cellulose (HPMC, Methocel K35LV available from Dow Chemical Company), 25 percent by weight of ethylene oxide/hydroxypropyl methacrylate/ethylene oxide triblock copolymers, which were synthesized via free radical polymerization of hydroxypropyl methacrylate with 2-aminoethanethiol using α,α'-azobisisobutyronitrile as initiator and reacting the resulting amino-semitelechelic aminohydroxypropyl methacrylate with an isocyanate-polyethylene oxide complex in chlorobenzene at 0° C., and precipitating the reaction mixture in diethylether, and 25 percent by weight of 2-dimethyl aminoethyl phosphonium bromide (Aldrich 21,544-9), which blend was present in a concentration of 4 percent by weight in water. Subsequent to air drying at 100° C. and monitoring the difference in weight prior to and subsequent to coating, the dried MYLAR™ base sheet rolls were coated 1.5 grams in a thickness of 15 microns of the two layered transparency structures. Rewinding the coated side of the MYLAR™ base sheet (roll form) on to an empty core and using these rolls, the uncoated side of the MYLAR™ base sheet was coated on a Faustel Coater using a two slot die simultaneously with two hydrophilic polymeric layers where the first layer in contact with the substrate was a blend of 50.0 percent by weight of ethylenevinylacetate latex, Airflex from Air Products and Chemicals Inc., 25.0 percent by weight of sodium carboxymethylhydroxyethyl cellulose, CMHEC 37L available from Hercules Chemical Company, 20.0 percent by weight of sodium carboxymethylhydroxyethyl cellulose, CMHEC 43H available from Hercules Chemical Company, 4 percent by weight of UV absorbing compound poly[N,N-bis(2,2,6,6-tetramethyl-4-piperidinyl)-1,6-hexanediamine-co-2,4-dichloro-6-morpholino-1,3,5-triazine](Cyasorb UV-3346, #41,324-0, available from Aldrich Chemical Company), and 1 percent by weight of a biocide compound, Kathon LX, from Rohm and Haas Company, which blend was present in a concentration of 6 percent by weight in water and the second layer in contact with the first layer was a blend of 50 percent by weight of hydroxy propyl methyl cellulose (HPMC, Methocel K35LV available from Dow Chemical Company), 25 percent by weight of ethylene oxide/hydroxypropyl methacrylate/ethylene oxide triblock copolymers, which were synthesized via free radical polymerization of hydroxypropyl methacrylate with 2-aminoethanethiol using α,α'-azobisisobutyronitrile as initiator and reacting the resulting amino-semitelechelic amino-hydroxypropyl methacrylate with an isocyanate-polyethylene oxide complex in chlorobenzene at 0° C., and precipitating the reaction mixture in diethylether, and 25 percent by weight of 2-dimethyl aminoethyl phosphonium bromide (Aldrich 21,544-9) which blend was present in a concentration of 4 percent by weight in water. Subsequent to air drying at 100° C. and monitoring the difference in weight prior to and subsequent to coating, the dried MYLAR™ base sheet rolls were coated 1.5 grams in a thickness 15 microns of the two layered transparency structure. The transparency sheets thus prepared had a haze value of 4.

These transparencies were incorporated into a Hewlett-Packard 500-C color ink jet printer containing the same inks as those used in Example I. Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 watts output power at 2450 MHz frequency. The black images were "process black" (i.e., formed by superimposition of cyan, magenta, and yellow images). The resulting images dried in less than 10 seconds and yielded optical density values of 1.75 black, 1.75 cyan, 1.60 magenta and 0.95 yellow. These images had lightfastness values better than 85 percent and, more specifically, an average of 86 for all colors after a period of six months and showed no intercolor bleed when kept at 80 percent humidity at 80° F. for a period of seven days.

In a comparative study, Hewlett Packard Desk Jet Transparency 51636 F printed with a 550-C printer containing Hewlett Packard inks had a lightfastness value of 17 percent for magenta, 83 percent for yellow, and 4 percent for cyan after 50 hours in a UV fadometer (equivalent to two months of sunshine). Hewlett Packard Desk Jet Transparency 51636 F with an ink receiving layer of 6 to 7 microns has a haze value of 7 percent. When the ink receiving layer is 20 microns thick, the haze values would be substantially higher than 15 to 20 percent.

Other embodiments and modifications of the present invention may occur to those skilled in the art subsequent to a review of the information presented herein; these embodiments and modifications, as well as equivalents thereof, are also included within the scope of this invention.

What is claimed is:

1. A transparency consisting essentially of a supporting substrate, thereover and thereunder a first coating layer comprised of a binder having a glass transition temperature in the range of from about 10° to about 54° C., a cellulosic viscosity modifier, a lightfastness inducing agent and a biocide, and wherein said binder is present in an amount of from about 20 percent by weight to about 50 percent by weight, the viscosity modifier is present in an amount of from about 78 percent by weight to about 37 percent by weight, the lightfastness inducing agent is present in an amount of from about 1.9 percent by weight to about 10 percent by weight, and the biocide is present in an amount of from about 0.1 percent by weight to about 3 percent by weight; and a second ink-receiving coating layer thereover and thereunder comprised of a hydrophilic binder, an oxyalkylene compound, a dye mordant, filler, and biocide, and wherein the binder is present in an amount of from about 20 percent by weight to about 68.9 percent by weight, the oxyalkylene compound is present in an amount of from about 42 percent by weight to about 20 percent by weight, the dye mordant is present in an amount of from about 30 percent by weight to about 10 percent by weight, the filler is present in an amount of from about 5 to about 1 percent by weight, and the biocide is present in an amount of from about 3 to about 0.1 percent by weight; and wherein the first coating is in contact with the substrate and is situated between the substrate and the second ink coating, and which transparency possesses a haze value of from about 1 to about 10 and a lightfastness value of from about 70 to about 95.

2. A transparency in accordance with claim 1 wherein the binder of the first coating layer is formed from a water dispersed latex selected from the group consisting of (1) rubber latex, (2) polyester latex, (3) vinyl chloride latex, (4) ethylene-vinyl chloride copolymer latex, (5) polyvinyl acetate homopolymer latex, (6) ethylene-vinyl acetate copolymer latex, (7) acrylic-vinyl acetate copolymer latex, (8) vinyl acrylic terpolymer latex, (9) polystyrene latex, (10) styrene-butadiene latex, (11) butadiene-acrylonitrile latex, (12) butadiene-acrylonitrile-styrene terpolymer latex, (13) acrylic emulsion latex, and mixtures thereof.

3. A transparency in accordance with claim 2 wherein mixtures thereof are comprised of two latexes, and wherein the first latex is present in an amount of from about 25 to about 75 weight percent, or parts, and wherein the second latex is present in an amount of from about 25 to about 75 weight percent, or parts.

4. A transparency in accordance with claim 1 wherein the binder is formed from a latex comprised of an acrylic emulsion latex, a polyester latex, or an acrylic-vinyl acetate and vinyl acrylic terpolymer latex, and present in the first coating in amounts of from about 25 to 40 percent by weight of the coating solids.

5. A transparency in accordance with claim 1 wherein the binder of the first coating layer is a water soluble binder selected from the group consisting of (1) melamine-formaldehyde resin, (2) urea-formaldehyde resin, (3) alkylated urea-formaldehyde resins, (4) vinyl methyl ether-maleic anhydride copolymer, (5) ethylene-maleic anhydride copolymers, (6) butadiene-maleic acid copolymers, (7) octadecene-1-maleic anhydride copolymer, (8) polyvinylmethylether, (9) vinylmethylether-maleic acid copolymer, (10) methyl vinyl ether-maleic acid ester, and mixtures thereof.

6. A transparency in accordance with claim 1 wherein the water soluble binder of the first coating layer is selected from the group consisting of ethylene-maleic anhydride copolymers, and polyvinylmethylether vinylmethylether-maleic acid copolymers present in the first coating in amounts of from about 25 to 40 percent by weight of the total solids in the coating.

7. A transparency in accordance with claim 1 wherein the cellulosic viscosity modifier of the first coating layer is selected from the group consisting of (1) starch, (2) cationic starch, (3) hydroxypropyl starch, (4) hydroxyethyl starch, (5) gelatin, (6) methyl cellulose, (7) benzyl cellulose, (8) phenyl cellulose, (9) hydroxyethyl cellulose, (10) hydroxypropyl cellulose, (11) ethyl hydroxyethyl cellulose, (12) hydroxyethyl methyl cellulose, (13) hydroxypropyl methyl cellulose, (14) hydroxy butylmethyl cellulose, (15) dihydroxypropyl cellulose, (16) hydroxypropyl hydroxyethyl cellulose, (17) chlorodeoxycellulose, (18) amino deoxycellulose, (19) diethylammonium chloride hydroxy ethyl cellulose, (20) hydroxypropyl trimethyl ammonium chloride hydroxyethyl cellulose, (21) DEAE cellulose, (22) carboxymethyl dextrans, (23) diethyl aminoethyl dextran, (24) amino dextran, (25) sodium carboxymethyl cellulose, (26) gum arabic, (27) carrageenan, (28) karaya gum, (29) xanthan, (30) chitosan, (31) carboxymethyl hydroxypropyl guar, (32) cationic guar, (33) n-carboxymethyl chitin, (34) dimethyl ammonium hydrolyzed collagen protein, (35) agar-agar, (36) sodium cellulose sulfate, (37) sodium carboxymethylhydroxyethyl cellulose, and mixtures thereof; and optionally wherein said mixture is comprised of two components with the first component being present in an amount of from about 25 percent to about 75 weight percent, or parts, and the second component is present in an amount of from about 75 percent to about 25 weight percent, or parts.

8. A transparency in accordance with claim 1 wherein the cellulosic viscosity modifier of the first coating layer is selected from the group consisting of hydroxyethyl methyl cellulose, hydroxypropyl trimethyl ammonium chloride hydroxyethyl cellulose, and sodium carboxymethylhydroxyethyl cellulose present in an amount of from about 40 percent by weight to about 65 percent by weight of the total solids in the coating.

9. A transparency in accordance with claim 1 wherein the lightfastness inducing agent of the first coating is a UV absorbing compound selected from the group consisting of (1) 2-(4-benzoyl-3-hydroxyphenoxy)ethylacrylate, (2) 1,2-hydroxy-4-(octyloxy)benzophenone, (3) poly[2-(4-benzoyl-3-hydroxyphenoxy)ethylacrylate], (4) hexadecyl-3,5-di-tert-butyl-4-hydroxy-benzoate, (5) poly[N,N-bis(2,2,6,6-tetramethyl-4-piperidinyl)-1,6-hexanediamine-co-2,4-dichloro-6-morpholino- 1,3,5-triazine], (6) 2-dodecyl-N-(2,2,6,6-tetramethyl-4-piperidinyl) succinimide, (7) 2-dodecyl-N-(1,2,2,6,6-pentamethyl-4-piperidinyl) succinimide, (8) N-(1-acetyl-2,2,6,6-tetramethyl-4-piperidinyl)-2-dodecyl succinimide, (9) 1-[N-[poly(3-allyloxy-2-hydroxypropyl)-2-aminoethyl]-2-imidazolidinone, (10) poly(2-ethyl-2-oxazoline), and mixtures thereof.

10. A transparency in accordance with claim 1 wherein the lightfastness inducing agent of the first coating is a UV absorbing compound selected from the group consisting of poly[N,N-bis(2,2,6,6-tetramethyl-4-piperidinyl)- 1,6-hexanediamine-co-2,4-dichloro-6-morpholino-1,3,5-triazine], 1-[N-[poly(3-allyloxy-2-hydroxypropyl)-2-aminoethyl]-2-imidazolidinone], and 2-dodecyl-N-(1,2,2,6,6-pentamethyl-4-piperidinyl) succinimide present in an amount of from about 3 percent by weight to about 7 percent by weight of the total solids in the coating.

11. A transparency in accordance with claim 1 wherein the thickness of the first coating layer in contact with the substrate is from about 0.1 to about 25 microns.

12. A transparency in accordance with claim 1 wherein in the first coating layer the binder is present within the coating in amounts of from about 20 percent by weight to about 90 percent by weight, the cellulosic viscosity modifier is present in amounts of from about 20 percent by weight to about 90 percent by weight, the lightfastness inducing agent is present in amounts of from about 0.5 percent by weight to about 20 percent by weight, and the biocide is present in amounts of from about 0.1 percent by weight to about 3 percent by weight of the total solids in the coating.

13. A transparency in accordance with claim 1 wherein the hydrophilic polymeric binder of the second coating layer is selected from the group consisting of (1) poly(vinyl alcohol), (2) poly(vinyl phosphate), (3) poly(vinyl pyrrolidone), (4) vinyl pyrrolidone-vinyl acetate copolymers, (5) vinyl pyrrolidone-styrene copolymers, (6) poly(vinylamine), (7) poly(vinyl alcohol) ethoxylated, (8) poly(vinyl pyrrolidone-diethylaminomethylmethacrylate), (9) vinyl alcohol-vinyl acetate copolymer, (10) vinyl alcohol-vinyl butyral copolymer, (11) melamine-formaldehyde resin, (12) urea-formaldehyde resin, (13) methylated urea-formaldehyde resins, (14) poly(2-acrylamide-2-methyl propane sulfonic acid), (15) poly(N, N-dimethyl-3,5-dimethylene piperidinium chloride), (16) poly(methylene-guanidine) hydrochloride (17) styrene-butadiene latexes, (18) ethylene-vinylacetate latex, (19) vinyl acetate-acrylic copolymer latexes, (20) styrene-maleic anhydride copolymers, (21) vinyl methyl ethermaleic anhydride copolymer, (22) ethylene-maleic anhydride copolymer, (23) butadiene-maleic acid copolymers, (24) vinylmethylether-maleic acid copolymer, (25) methyl vinyl ether-maleic acid ester, (26) poly(acrylamide), (27) acrylamide-acrylic acid copolymers, (28) poly(N,N-dimethyl acrylamide) (29) poly(ethylene imine), (30) poly (ethylene imine) epichlorohydrin, (31) ethoxylated poly imine, and mixtures thereof; and optionally wherein said mixture is comprised of two components with the first component being present in an amount of from about 25 weight percent to about 75 weight percent, or parts, and the second component is present in an amount of from about 75 weight percent to about 25 weight percent, or parts.

14. A transparency in accordance with claim 1 wherein the hydrophilic polymeric binder of the second coating layer is selected from the group consisting of poly(vinyl alcohol), poly(vinyl pyrrolidone), vinyl pyrrolidone-vinyl acetate copolymers, and vinyl alcohol-vinyl acetate copolymer present in an amount of from about 20 percent by weight to about 45 percent by weight of the total solids in the coating.

15. A transparency in accordance with claim 1 wherein the hydrophilic polymeric binder of the second layer coatings is selected from the group consisting of (1) starch, (2) cationic starch, (3) hydroxypropyl starch, (4) hydroxyethyl starch, (5) gelatin, (6) methyl cellulose, (7) benzyl cellulose, (8) phenyl cellulose, (9) hydroxyethyl cellulose, (10) hydroxypropyl cellulose, (11) ethyl hydroxyethyl cellulose, (12) hydroxyethyl methyl cellulose, (13) hydroxypropyl methyl cellulose, (14) hydroxy butylmethyl cellulose, (15) dihydroxypropyl cellulose, (16) hydroxypropyl hydroxyethyl cellulose, (17) chlorodeoxycellulose, (18) amino deoxycellulose, (19) diethylammonium chloride hydroxy ethyl cellulose, (20) hydroxypropyl trimethyl ammonium chloride hydroxyethyl cellulose, (21) DEAE cellulose, (22) carboxymethyl dextrans, (23) diethyl aminoethyl dextran, (24) amino dextran, (25) sodium carboxymethyl cellulose, (26) gum arabic, (27) carrageenan, (28) karaya gum, (29) xanthan, (30) chitosan, (31) carboxymethyl hydroxypropyl guar, (32) cationic guar, (33) n-carboxymethyl chitin, (34) dimethyl ammonium hydrolyzed collagen protein, (35) agar-agar, (36) sodium cellulose sulfate, (37) sodium carboxymethylhydroxyethyl cellulose, and mixtures thereof.

16. A transparency in accordance with claim 1 wherein the hydrophilic polymeric binder of the second coating layer is selected from the group consisting of hydroxypropyl methyl cellulose, hydroxy butylmethyl cellulose, and diethylammonium chloride hydroxy ethyl cellulose present in amounts of from about 40 percent by weight to about 75 percent by weight of the total solids in the coating.

17. A transparency in accordance with claim 1 wherein the oxyalkylene is a hydrophilic-polyoxyalkylene containing polymer selected from the group consisting of (1) poly (ethylene oxide), (2) ethylene oxide/propylene oxide copolymers, (3) ethylene oxide/2-hydroxyethyl methacrylate/ethyleneoxide, (4) ethylene oxide/hydroxypropyl methacrylate/ethylene oxide triblock copolymers, (5) ionene/ethylene oxide/ionene triblock copolymers, (6) ethylene oxide/isoprene/ethylene oxide triblock copolymers, (7) epichlorohydrin-ethylene oxide copolymer, and mixtures thereof.

18. A transparency in accordance with claim 17 wherein said hydrophilic-polyoxyalkylene containing polymers are poly(ethylene oxide), and ethylene oxide/propylene oxide copolymers present in amounts of from about 20 percent by weight to about 35 percent by weight of the total solids in the coating.

19. A transparency in accordance with claim 1 wherein the dye mordant of the second coating layer composition is selected from the group consisting of (1) ammonium quaternary salts, (2) phosphonium quaternary salts, (3) sulfonium quaternary salts, (4) thiazolium quaternary salts, (5) benzothiazolium quaternary salts, and mixtures thereof.

20. A transparency in accordance with claim 19 wherein the dye is quaternized polymethyl acrylate trimethyl ammonium chloride latex, hexamethylene bistrimethyl ammonium bromide, 2-dimethyl aminoethyl phosphonium bromide present in amounts of from about 10 percent by weight to about 30 percent by weight of the total solids in the coating.

21. A transparency in accordance with claim 1 wherein the thickness of the second coating layer in contact with the first coating layer is from about 0.1 to about 25 microns, and wherein said transparency possesses a haze value of from about 4 to about 10.

22. A transparency in accordance with claim 1 wherein in the second coating layer the binder is present in an amount of from about 20 percent by weight to about 90 percent by weight, the oxyalkylene compound is present in an amount of from about 20 percent by weight to about 90 percent by weight, and the dye mordant is present in amounts of from about 0.5 percent by weight to about 20 percent by weight of the total solids in the coating.

23. A transparency in accordance with claim 1 wherein the thickness of the first coating is from about 2 to about 10 microns, and the thickness of the second coating is from about 5 to about 15 microns.

24. A transparency in accordance with claim 1 wherein the haze value is from about 1 to about 5.

25. A transparency in accordance with claim 1 wherein the lighfastness value is from about 80 to about 86 percent.

26. A transparency in accordance with claim 1 wherein the substrate is selected from the group consisting of (1) polyesters, (2) polyethylene naphthalates, (3) polycarbonates, (4) polysulfones, (5) polyether sulfones, (6) poly(arylene sulfones), (7) cellulose triacetate, (8) polyvinyl chloride, (9) cellophane, (10) polyvinyl fluoride, (11) polypropylene, and (12) polyimides.

27. A transparency in accordance with claim 1 wherein said haze value is from 4 to 9, and said lightfastness is from 80 to 90.

28. A transparency in accordance with claim 1 containing four coatings, said first and second coating thereover said substrate, and said first and second coating thereunder said substrate.

29. A transparency consisting of a supporting substrate, thereover and thereunder a first coating layer comprised of a binder having a glass transition temperature in the range of from about 10° to about 54° C., a cellulosic viscosity modifier, a lightfastness inducing agent and a biocide, and wherein said binder is present in an amount of from about 20 percent by weight to about 50 percent by weight, the viscosity modifier is present in an amount of from about 78 percent by weight to about 37 percent by weight, the lightfastness inducing agent is present in an amount of from about 1.9 percent by weight to about 10 percent by weight, and the biocide is present in an amount of from about 0.1 percent by weight to about 3 percent by weight; and a second ink-receiving coating layer thereover and thereunder comprised of a hydrophilic binder, an oxyalkylene compound, a dye mordant, filler, and biocide, and wherein the binder is present in an amount of from about 20 percent by weight to about 68.9 percent by weight, the oxyalkylene compound is present in an amount of from about 42 percent by weight to about 20 percent by weight, the dye mordant is present in an amount of from about 30 percent by weight to about 10 percent by weight, the filler is present in an amount of from about 5 to about 1 percent by weight, and the biocide is present in an amount of from about 3 to about 0.1 percent by weight; and wherein the first coating is in contact with the substrate and is situated between the substrate and the second ink coating, and which transparency possesses a haze value of from about 1 to about 10 and a lightfastness value of from about 70 to about 95.

* * * * *